US009725980B2

(12) United States Patent
Hallundbæk et al.

(10) Patent No.: US 9,725,980 B2
(45) Date of Patent: Aug. 8, 2017

(54) ANNULAR BARRIER WITH PRESSURE AMPLIFICATION

(75) Inventors: Jørgen Hallundbæk, Græsted (DK); Paul Hazel, Aberdeen (GB); Ricardo Reves Vasques, Holte (DK)

(73) Assignee: Welltec A/S, Allerød (DK)

( * ) Notice: Subject to any disclaimer, the term of this patent is extended or adjusted under 35 U.S.C. 154(b) by 273 days.

(21) Appl. No.: 14/238,239

(22) PCT Filed: Aug. 30, 2012

(86) PCT No.: PCT/EP2012/066870
§ 371 (c)(1),
(2), (4) Date: Feb. 11, 2014

(87) PCT Pub. No.: WO2013/030283
PCT Pub. Date: Mar. 7, 2013

(65) Prior Publication Data

US 2014/0216755 A1 Aug. 7, 2014

(30) Foreign Application Priority Data

Aug. 31, 2011 (EP) ..... 11179545

(51) Int. Cl.
*E21B 33/12* (2006.01)
*E21B 23/06* (2006.01)
(Continued)

(52) U.S. Cl.
CPC ..... *E21B 33/127* (2013.01); *E21B 23/06* (2013.01); *E21B 33/1243* (2013.01)

(58) Field of Classification Search
CPC .... E21B 23/06; E21B 33/127; E21B 33/1243; E21B 33/1285
See application file for complete search history.

(56) References Cited

U.S. PATENT DOCUMENTS 2,786,535 A * 3/1957 Boer ..... E21B 21/10 166/142
3,503,445 A * 3/1970 Cochrum ..... E21B 21/103 166/151
(Continued)

FOREIGN PATENT DOCUMENTS

CN 2 900 771 5/2007
RU 2 100 568 C1 12/1997
(Continued)

OTHER PUBLICATIONS

International Search Report for PCT/EP2012/066870, mailed Oct. 19, 2012.
(Continued)

*Primary Examiner* — Jennifer H Gay
(74) *Attorney, Agent, or Firm* — Nixon & Vanderhye P.C.

(57) ABSTRACT

The present invention relates to an annular barrier to be expanded in an annulus between a well tubular structure and an inside wall of a borehole for providing zone isolation between a first zone and a second zone of the borehole, comprising a tubular part for mounting as part of the well tubular structure and having an expansion opening, an expandable sleeve surrounding the tubular part, each end of the expandable sleeve being connected with the tubular part, and an annular barrier space between the tubular part and the expandable sleeve, wherein the annular barrier further comprises a pressure intensifying means having an inlet in a first end in fluid communication with the expansion opening and having an outlet in a second end in fluid communication with the annular barrier space.

14 Claims, 5 Drawing Sheets

(51) Int. Cl.
*E21B 33/127* (2006.01)
*E21B 33/124* (2006.01)

(56) References Cited

U.S. PATENT DOCUMENTS 3,850,240 A * 11/1974 Conover ..... E21B 23/06 166/162
4,299,397 A * 11/1981 Baker ..... E21B 33/127 137/625.67
4,474,380 A 10/1984 Carter
4,527,625 A * 7/1985 Wood ..... E21B 33/127 166/187
4,577,696 A * 3/1986 Suman ..... E21B 33/1243 166/187
4,586,526 A * 5/1986 Reardon ..... E21B 33/127 137/461
4,653,588 A * 3/1987 White ..... E21B 33/127 166/187
4,655,292 A 4/1987 Halbardier
4,962,812 A * 10/1990 Berzin ..... E21B 34/063 166/187
5,271,469 A * 12/1993 Brooks ..... E21B 33/127 166/187
5,366,010 A 11/1994 Zwart
5,400,855 A * 3/1995 Stepp ..... E21B 33/127 166/151
5,473,939 A 12/1995 Leder et al.
5,605,195 A * 2/1997 Eslinger ..... E21B 33/127 166/187
5,897,095 A * 4/1999 Hickey ..... E21B 34/10 138/31
6,651,749 B1 * 11/2003 Kilgore ..... E21B 23/04 166/106
7,387,157 B2 * 6/2008 Gambier ..... E21B 23/06 166/185
9,080,415 B2 * 7/2015 Hallundbæk ..... E21B 33/1208
2003/0075342 A1 4/2003 Gunnarson
2005/0011678 A1 1/2005 Akinlade et al.
2005/0023004 A1 * 2/2005 King et al. ..... E21B 23/06 166/387
2005/0150661 A1 * 7/2005 Kenison ..... E21B 33/1243 166/387
2005/0217869 A1 10/2005 Doane et al.
2006/0042801 A1 * 3/2006 Hackworth ..... E21B 29/10 166/387
2007/0012444 A1 * 1/2007 Horgan ..... E21B 43/088 166/278
2007/0017683 A1 * 1/2007 O'Malley ..... E21B 33/126 166/387
2007/0056749 A1 * 3/2007 Gambier ..... E21B 33/127 166/387
2008/0110626 A1 * 5/2008 Allison ..... E21B 23/06 166/288
2009/0283279 A1 11/2009 Patel et al.
2011/0266004 A1 * 11/2011 Hallundbaek ..... E21B 33/1208 166/369
2012/0000676 A1 * 1/2012 Mebratu ..... E21B 33/1285 166/387
2013/0175094 A1 * 7/2013 Ross ..... E21B 23/00 175/57
2014/0216755 A1 * 8/2014 Hallundæk ..... E21B 23/06 166/373
2014/0311751 A1 * 10/2014 Hallundb k ..... E21B 33/1208 166/369

FOREIGN PATENT DOCUMENTS

RU 2 101 463 C1 1/1998
RU 65 561 3/2007
RU 2 409 736 C1 1/2011
SU 1 113 514 9/1984
WO WO 00/37769 6/2000
WO WO 01/80650 11/2001
WO WO 03/048508 6/2003
WO WO 2010079237 A1 * 7/2010

OTHER PUBLICATIONS

International Preliminary Report on Patentability for PCT/EP2012/066870, mailed Aug. 14, 2013.
Decision to Grant issued in related Russian Application No. 2013156840/03(088621) dated May 30, 2016, with English translation, 22 pages.
Decision to Grant issued in related Russian Application No. 2013156840/03(088621) dated May 30, 2016, 11 pages.

* cited by examiner

ANNULAR BARRIER WITH PRESSURE AMPLIFICATION

This application is the U.S. national phase of International Application No. PCT/EP2012/066870 filed 30 Aug. 2012 which designated the U.S. and claims priority to EP Patent Application No. 11179545.6 filed 31 Aug. 2011, the entire contents of each of which are hereby incorporated by reference.

FIELD OF THE INVENTION

The present invention relates to an annular barrier arranged in a borehole for providing zone isolation between a first zone and a second zone. Furthermore, the present invention relates to an annular barrier system as well as to a method of placing an annular barrier in an annulus and a method of using annular barriers in an annulus to seal off an inflow control section.

BACKGROUND ART

In wellbores, annular barriers are used for different purposes, such as for providing an isolation barrier. An annular barrier has a tubular part mounted as part of the well tubular structure, such as the production casing, which is surrounded by an annular expandable sleeve. The expandable sleeve is typically made of an elastomeric material, but may also be made of metal. The sleeve is fastened at its ends to the tubular part of the annular barrier.

In order to seal off a zone between a well tubular structure and the borehole or an inner and an outer tubular structure, a second annular barrier is used. The first annular barrier is expanded on one side of the zone to be sealed off, and the second annular barrier is expanded on the other side of that zone, and in this way, the zone is sealed off.

The pressure envelope of a well is governed by the burst rating of the tubular and the well hardware etc. used within the well construction. In some circumstances, the expandable sleeve of an annular barrier may be expanded by increasing the pressure within the well, which is the most cost-efficient way of expanding the sleeve. The burst rating of a well defines the maximum pressure that can be applied to the well for expanding the sleeve, and it is desirable to minimise the expansion pressure required for expanding the sleeve in order to minimise the exposure of the well to the expansion pressure.

When expanded, annular barriers may be subjected to a continuous pressure or a periodic high pressure from the outside, either in the form of hydraulic pressure within the well environment or in the form of formation pressure. In some circumstances, such pressure may cause the annular barrier to collapse, which may have severe consequences for the area which is to be sealed off by the barrier as the sealing properties are lost due to the collapse.

Current requirements for collapse ratings have lead to the use of increasingly higher expansion pressures. However, not only burst ratings are affected by increasing expansion pressures, also a variety of downhole tools may become ineffective or stop functioning under high pressures. Therefore, some wells have limited the allowed expansion pressure used in the well to protect tools and instruments present in the well. The problem may be circumvented by decreasing the thickness or strength of the expandable sleeve. However, this impairs the collapse rating.

SUMMARY OF THE INVENTION

It is an object of the present invention to wholly or partly overcome the above disadvantages and drawbacks of the prior art. More specifically, it is an object to provide an annular barrier being expandable without damaging other components in the completion and without reducing the collapse rating of the annular barrier.

The above objects, together with numerous other objects, advantages, and features, which will become evident from the below description, are accomplished by a solution in accordance with the present invention by an annular barrier to be expanded in an annulus between a well tubular structure and an inside wall of a borehole for providing zone isolation between a first zone and a second zone of the borehole, comprising:

- a tubular part for mounting as part of the well tubular structure and having an expansion opening,
- an expandable sleeve surrounding the tubular part, each end of the expandable sleeve being connected with the tubular part, and
- an annular barrier space between the tubular part and the expandable sleeve, wherein the annular barrier further comprises a pressure intensifying means having an inlet in a first end in fluid communication with the expansion opening and having an outlet in a second end in fluid communication with the annular barrier space, and wherein the pressure intensifying means comprises a piston having a first end and a second end, the piston being slidably arranged within a piston housing, the piston housing comprising a first cylinder having a first diameter fitting the first end of the piston and having a first end surface area, and a second cylinder having a second diameter fitting the second end of the piston and having a second end surface area, the first end surface area being larger than the second end surface area, and wherein the pressure intensifying means further comprises a feed fluid connection for allowing fluid to enter the second cylinder, and wherein the pressure intensifying means further comprises a first one-way check valve arranged in the feed fluid connection for preventing fluid from exiting the second cylinder during compression of fluid by the piston and for allowing fluid to enter the second cylinder during decompression of fluid by the piston.

The pressure intensifying means may further comprise a second one-way check valve arranged between the feed fluid connection and the outlet of the pressure intensifying means for preventing pressurised fluid from entering the second cylinder during decompression of fluid by the piston and for allowing pressurised fluid to exit the pressure intensifying means through the outlet during compression of fluid by the piston.

In one embodiment, the pressure intensifying means may comprise a piston having a first end and a second end, the piston being slidably arranged within a piston housing, and the first end of the piston may have a first end surface area larger than a second end surface area of the second end of the piston.

In another embodiment, the pressure intensifying means may comprise a piston having a first end and a second end, the piston being slidably arranged within a piston housing, and the first end of the piston may have a first end surface area larger than a second end surface area of the second end of the piston, and the piston housing may comprise two cylinders; a first cylinder having a first diameter fitting the first end of the piston and a second cylinder having a second diameter smaller than the first diameter and fitting the second end of the piston.

Also, the pressure intensifying means may comprise a plurality of pressure intensifying means.

Moreover, the pressure intensifying means may comprise a plurality of pistons.

Additionally, the outlet of the pressure intensifying means may comprise a pressure collecting chamber in fluid communication with a plurality of second ends of the plurality of pistons and in fluid communication with the annular barrier space.

Further, an excess fluid connection between the pressure intensifying means and the borehole may allow fluid to flow from the pressure intensifying means into the borehole.

In an embodiment, the pressure intensifying means may comprise a void within the piston housing between the first end and the second end of the piston.

Said void may be pressurised before use with atmospheric pressure.

The annular barrier as described above may further comprise a one-way valve arranged in fluid communication with the outlet of the pressure intensifying means and the annular barrier space, prohibiting fluid flow from the annular barrier space towards the pressure intensifying means.

The annular barrier as described above may also comprise a one-way valve arranged in fluid communication with the borehole and the annular barrier space, allowing fluid flow from the borehole into the annular barrier space.

Also, the annular barrier according to the present invention may comprise a first and a second pressure intensifying means arranged in series, the first pressure intensifying means comprising a first inlet and a first outlet and the first inlet being in fluid communication with the expansion opening, the second pressure intensifying means comprising a second inlet and a second outlet and the second outlet being in fluid communication with the annular barrier space.

In addition, the annular barrier may comprise a first and a second pressure intensifying means and at least one intermediate pressure intensifying means arranged in series, the first pressure intensifying means comprising a first inlet and a first outlet and the first inlet being in fluid communication with the expansion opening, the second pressure intensifying means comprising a second inlet and a second outlet and the second outlet being in fluid communication with the annular barrier space, and the at least one intermediate pressure intensifying means may comprise an intermediate inlet in fluid communication with the first outlet and an intermediate outlet being in fluid connection with second inlet.

Several intermediate pressure intensifying means may be placed in series, and neighbouring intermediate pressure intensifying means may comprise intermediate outlets being in fluid communication with intermediate inlets.

In one embodiment, the pressure intensifying means may comprise a hydraulic pressure intensifier.

Moreover, the hydraulic pressure intensifier may comprise a first cylinder having a first internal cross-sectional area in the first end of the pressure intensifying means and a second cylinder having a second internal cross-sectional area in the second end of the pressure intensifying means.

Furthermore, the hydraulic pressure intensifier may comprise a pilot control valve for controlling fluid communication between the first cylinder, the inlet of the pressure intensifying means and an excess fluid connection providing fluid communication from the pressure intensifying means to the borehole, the pilot control valve having two positions; a first position wherein fluid communication is provided between the first cylinder and the inlet of the pressure intensifying means for applying expansion fluid in the first cylinder during pressurisation and a second position providing fluid communication between the first cylinder and the excess fluid connection during retraction of the piston, enabling the expansion fluid to exit the first cylinder, and wherein the pilot control valve may be switched between said first and second positions by a pilot.

The hydraulic pressure intensifier may further comprise a first one-way check valve and a second one-way check valve, the first one-way check valve allowing expansion fluid to flow from the inlet of the pressure intensifying means into the second cylinder, but prohibits the pressure intensified fluid from flowing back from the second cylinder towards the inlet of the pressure intensifying means and the second one-way check valve, allowing pressure intensified expansion fluid to flow from the second cylinder towards the outlet of the pressure intensifying means and into the annular barrier space, but prohibits the pressure intensified fluid from flowing back from the annular barrier space towards the second cylinder.

In an embodiment, the excess fluid connection may comprise a filter.

Furthermore, the pressure intensifying means may comprise a double-acting piston.

The pressure intensifying means may comprise the double-acting piston further comprising a first and a second pilot control valve for controlling fluid communication between a first end and a second end of a first cylinder, a fluid direction control valve and a first and second excess fluid connection providing fluid communication from the pressure intensifying means to the borehole, the first pilot control valve having two positions; a first position wherein fluid communication is provided between the first end of the first cylinder and the fluid direction control valve for applying expansion fluid in the first end of the cylinder during pressurisation of a second end of a second cylinder, and a second position wherein fluid communication is provided between the first cylinder and the first excess fluid connection, and the second pilot control valve having two positions; a first position wherein fluid communication is provided between the second end of the first cylinder and the fluid direction control valve for applying expansion fluid in the second end of the first cylinder during pressurisation of a first end of a second cylinder, and a second position wherein fluid communication is provided between the second end of the first cylinder and the second excess fluid connection.

Said fluid direction control valve may be controlled by a first and a second pilot, the first pilot determining when the piston reaches a stop position in the first end of the first cylinder and the second pilot determining when the piston reaches a stop position in the second end of the first cylinder.

Also, the pressure intensifying means may comprise a hydraulic pressure intensifier with a double-acting piston.

In an embodiment, the pressure intensifying means may comprise a pressurised gas, and the pressurised gas may be released into the annular barrier by releasing a gas control valve by the expansion fluid.

Moreover, a second pressure intensifying means may be arranged in an end of the annular barrier opposite to the pressure intensifying means.

The present invention further relates to an annular barrier system comprising:

a well tubular structure, and at least an annular barrier according to any of the preceding claims arranged as part of the well tubular structure.

The present invention also relates to a method of placing an annular barrier as described above in an annulus, comprising the steps of:

connecting the annular barrier with a well tubular structure, placing the unexpanded annular barrier in a desired position downhole, pressurising a fluid within the tubular part, intensifying the pressure in the annular barrier space by the pressure intensifying means, and expanding the expandable sleeve.

Finally, the present invention relates to a method of using annular barriers as described above in an annulus to seal off an inflow control section, comprising the steps of:

connecting two annular barriers with a well tubular structure and in between them an inflow control section, placing the two annular barriers and the inflow control section in a desired position downhole, pressurising the tubular part and expanding the annular barriers by pressurised expansion fluid from within the tubular part for providing a zone isolation between a first zone and a second zone of the borehole, the first zone having a first fluid pressure and the second zone having a second fluid pressure, stopping the pressurising of the tubular part, and activating the inflow control section for starting a production of fluid into the well tubular structure.

BRIEF DESCRIPTION OF THE DRAWINGS

The invention and its many advantages will be described in more detail below with reference to the accompanying schematic drawings, which for the purpose of illustration show some non-limiting embodiments and in which.

All the figures are highly schematic and not necessarily to scale, and they show only those parts which are necessary in order to elucidate the invention, other parts being omitted or merely suggested.

DETAILED DESCRIPTION OF THE INVENTION

Figure 1:
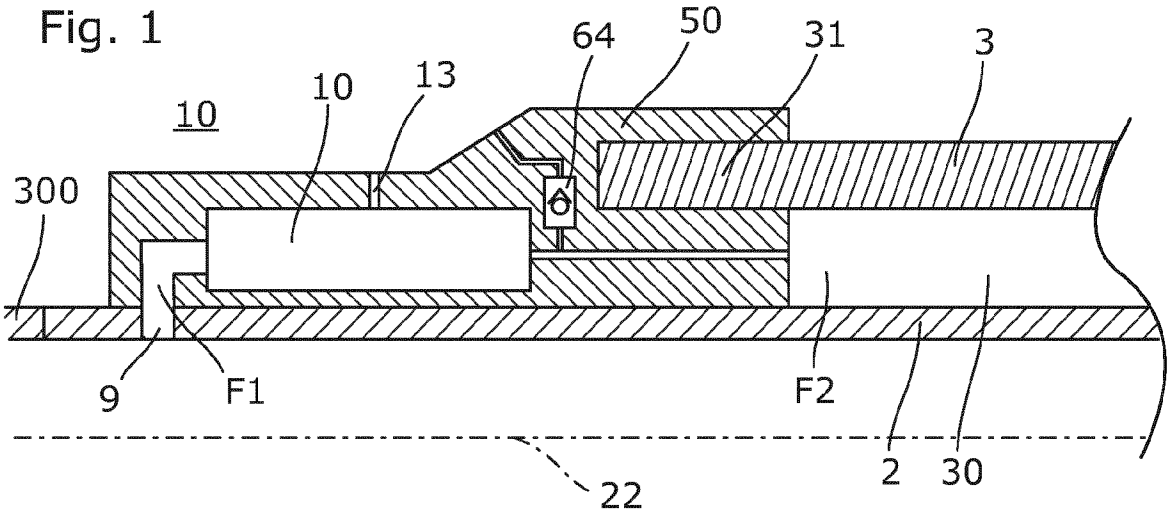
FIG. 1 shows a close-up of an annular barrier in its unexpanded condition.
Figure 2:
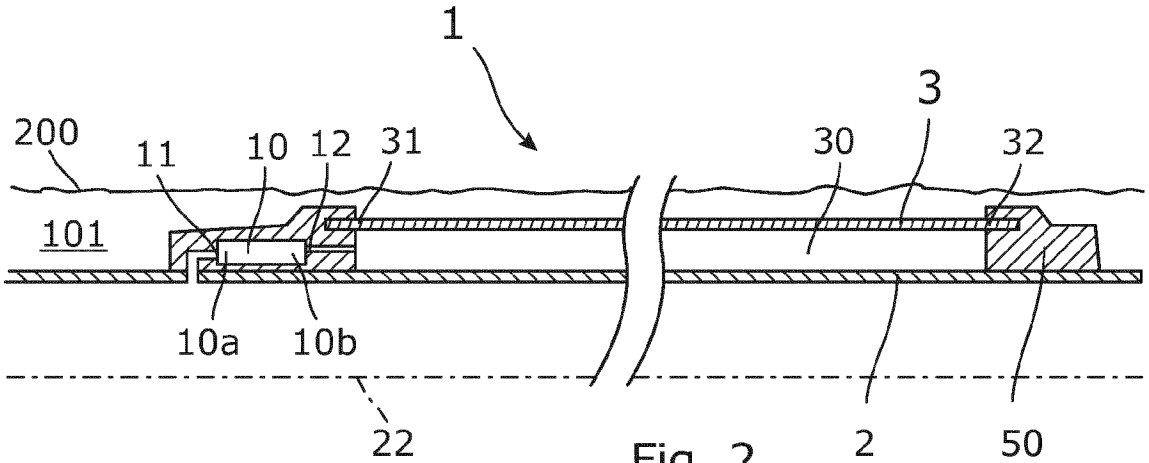
FIG. 2 shows a cross-sectional view along a longitudinal extension of an annular barrier in its unexpanded condition.

FIG. 2 shows an annular barrier 1 arranged in a borehole 100 comprising a tubular part 2 for mounting as part of a well tubular structure 300. The tubular part is surrounded by an expandable sleeve 3 and connected with the tubular part in both ends 31, 32 by connection means 50, thereby providing an annular barrier space 30 between the tubular part 2 and the expandable sleeve 3. The tubular part has an expansion opening 13 for allowing an expansion fluid F1 to enter the annular barrier in order to expand the expandable sleeve 3. The annular barrier furthermore comprises pressure intensifying means 10 which, in its first end 10*a*, has an inlet 11 in fluid communication with the expansion opening and which, in its second end 10*b*, has an outlet 12 in fluid communication with the annular barrier space 30. The line 22 shown in FIG. 1 is the centre line 22 of the annular barrier 1.

By arranging a pressure intensifying means between the expansion opening and the annular barrier space, a pressure provided within the well may be kept at a certain level that other components or parts of the completion can withstand, while significantly increasing the expansion pressure within the annular barrier space. By only increasing the expansion pressure within the annular barrier, the remaining part of the well may be pressurised at a pressure much lower than the expansion pressure in the annular barrier space required to expand the expandable sleeve when mounting an annular barrier according to the invention. A low pressure in the well is desirable for safety reasons, as some parts or components of the well will be damaged above a certain pressure, and in some well types providing a high pressure is even impossible. Therefore, the ability to expand annular barriers at a lower pressure may provide a more versatile annular barrier suitable for more types of wells and annular barriers can be used in more types of wells. Also, the annular barrier can be used in wells capable of withstanding high pressures, as the annular barrier may be significantly strengthened without requiring an additionally high burst rating of the well since a pressure intensified expansion fluid F2 may expand a much stronger annular barrier. The stronger annular barrier may therefore be more resistant to collapse, loss of sealing effect and corrosion.

In FIG. 1, a one-way valve 64 is arranged in fluid communication with the borehole and the annular barrier space 30, thereby allowing fluid flow from the borehole into the annular barrier space 30. In order to ensure a sudden high pressure in the borehole e.g. due to a gas explosion, fluid from the borehole may be allowed to enter the annular barrier space 30 through the one-way valve 64 to avoid collapse of the barrier due to an external pressure. Furthermore, an additional one-way valve may be arranged in the other end of the annular barrier (not shown) to allow fluid to enter the barrier from both a first zone 102 and a second zone 103 of the borehole.

Both pistons and plungers may be used in various embodiments of the invention. However, only the term piston will be used in the following to describe a moving element arranged in a cylinder to displace a fluid. The person skilled knows the advantages and disadvantages of using pistons or plungers.

Annular barriers 1 according to the present invention are typically mounted to form part of the well tubular structure, such as a production casing, before lowering the well tubular structure 300 into the borehole downhole. The well tubular structure 300 is constructed by well tubular structure parts assembled as a long well tubular structure string. The annular barriers 1 are mounted between other well tubular structure parts, such as inflow control sections, fracturing port section, etc. when mounting the well tubular structure string. The tubular part 2 may be connected with the well tubular structure parts, e.g. by means of a thread connection (not shown).

The annular barrier 1 is used for a variety of purposes, all of which require that the expandable sleeve 3 of the annular barrier 1 is expanded so that the sleeve abuts the inside wall 200 of the borehole. The unexpanded sleeve has a cylindrical shape, and at its ends it is connected with the tubular part by connection means 50. The expandable sleeve 3 is expanded by letting pressurised fluid in through the expansion opening 9 of the tubular part through the pressure intensifying means and into the annular barrier space 30 between the expandable sleeve 3 and the tubular part 2.

FIG. 2 shows a cross-sectional view along a longitudinal extension of an annular barrier in its unexpanded condition. As indicated by the cut through the middle of the annular barrier, the annular barriers are very long in the longitudinal direction of the barrier compared to the diameter of the barrier. The length of a barrier may be up to several meters, such as at least 5 or 10 meters whereas the diameter of the barrier is confined to the very limited space available in a borehole.

Figure 3:
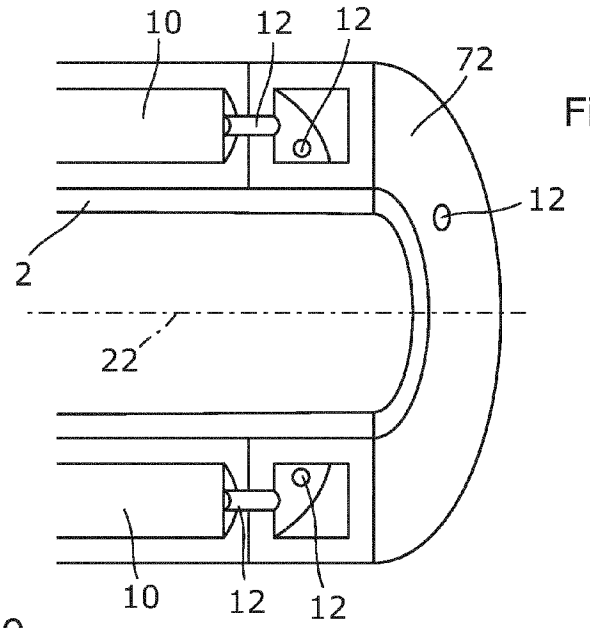
FIG. 3 shows a diagram of a hydraulic pressure intensifier.

FIG. 3 shows a cut view of a section of a pressure intensifying means 10, wherein the pressure intensifying means 10 comprises a collecting chamber 72 arranged as part of the outlet 12 in fluid communication with the plurality of second ends of the plurality of pistons and in fluid communication with the annular barrier space 30. The use of a plurality of pistons all letting fluid into a collecting chamber may prevent clogging effects since the risk of mechanical breakdowns in the pressure intensifying means is distributed on a plurality of pistons. If one of or more of the pistons clog e.g. due to large particles in the fluid, the rest of the pistons may still provide the required pressure.

Figure 4:
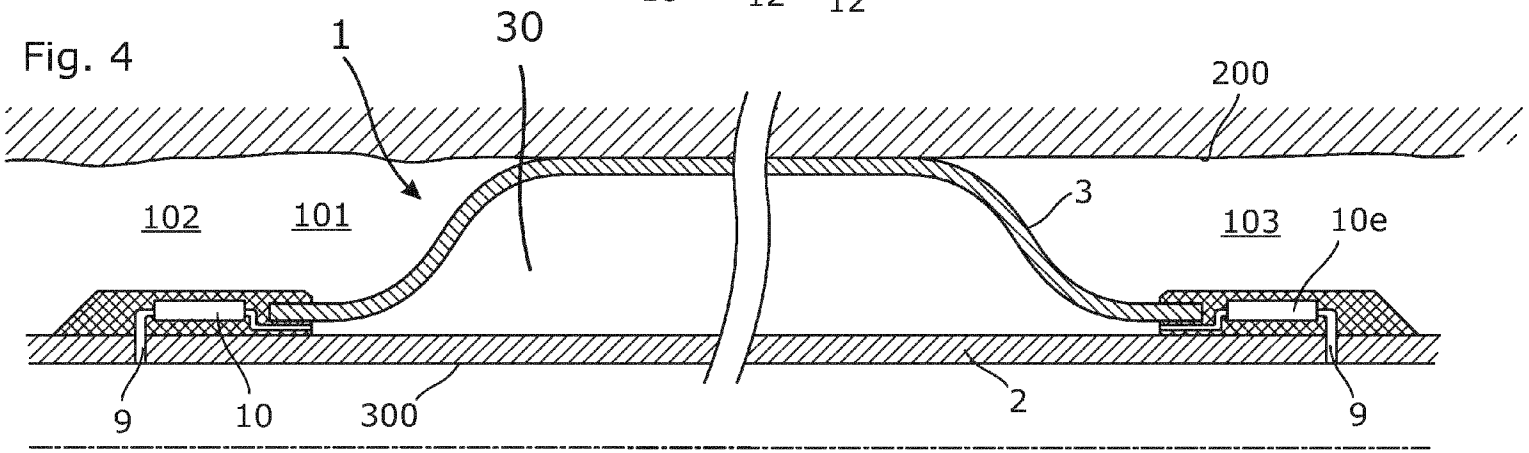
FIG. 4 shows the annular barrier of FIG. 1 in its expanded condition.

FIG. 4 shows a cross-sectional view along a longitudinal extension of an annular barrier in its expanded condition. Furthermore, the annular barrier 1 comprises a second pressure intensifying means 10*e*. For constructional reasons, a second pressure intensifying means 10*e* may be arranged in an end of the annular barrier opposite to the pressure intensifying means 10. Having pressure intensifying means 10, 10*e* in both ends of the annular barrier will not increase the pressure which may be reached within the annular barrier space 30. However, it may increase a speed with which the annular barrier is expanded.

As explained above, the space is very limited when operating downhole. However, speed is another important factor which may lower the downhole operation time and thereby lower costs of downhole operations.

Figure 5:
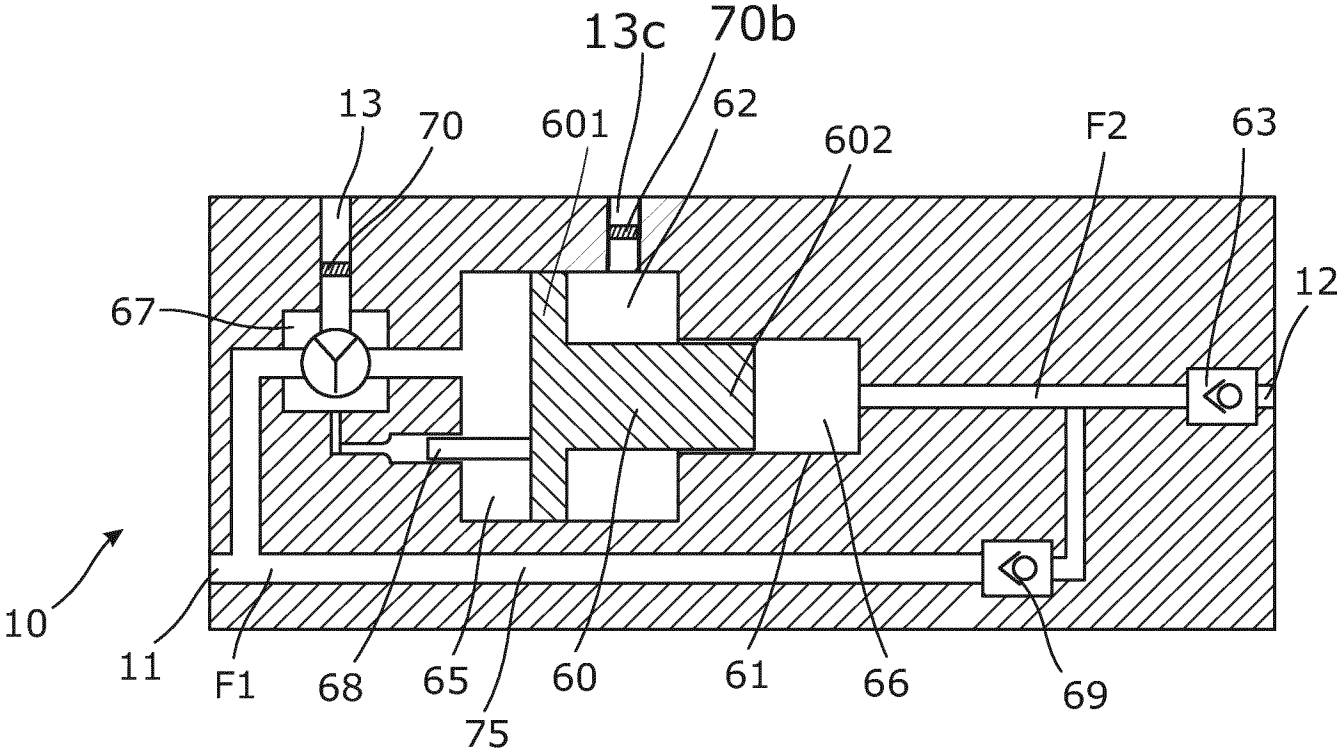
FIG. 5 shows diagram of a hydraulic pressure intensifier with a single-acting piston.

FIG. 5 shows a cross-sectional view of an embodiment of a hydraulic pressure intensifier. The hydraulic pressure intensifier 10 comprises a piston 60 having a first end 601 and a second end 602 and the piston being slidably arranged within a piston housing 61. The first end 601 of the piston has a first end surface area A1 larger than a second end surface area A2 of the second end 602 of the piston in order to be able to intensify the pressure applied to the first end surface area A1 to a higher pressure applied by the second end surface area A2 to the fluid inside the annular barrier space 30.

The piston housing may comprise two cylinders, a first cylinder 65 having a first diameter fitting the first end of the piston and a second cylinder 66 having a second diameter smaller than the first diameter fitting the second end of the piston.

The pressure intensifying means shown in FIG. 5 comprises a pilot control valve 67 for controlling fluid communication between the first cylinder 65, the inlet of the pressure intensifying means 10 and an excess fluid connection 13 providing fluid communication from the pressure intensifying means to the borehole 100 when the piston is retracted for letting a new amount of fluid into the second cylinder 66 having the smallest diameter. The pilot control valve has two positions. The first position allows fluid communication between the first cylinder and the inlet of the pressure intensifying means for applying expansion fluid F1 in the first cylinder during pressurisation and the second position allows fluid communication between the first cylinder and the excess fluid connection during retraction of the piston, enabling the expansion fluid F1 to exit the first cylinder. The pilot control valve may automatically be switched between said first and second positions by a pilot 68 when the piston reaches its extremum positions in either end of the piston housing. Furthermore, the pressure intensifying means may comprise a first one-way check valve 69 and a second one-way check valve 63. The first one-way check valve 69 allows the expansion fluid F1 to flow from the inlet of the pressure intensifying means 10 into the second cylinder 66, but prohibits the pressure intensified fluid F2 from flowing back from the second cylinder 66 towards the inlet 11 of the pressure intensifying means. In this way, the high pressure side of the pressure intensifying means may be fed by the expansion fluid from the inlet during retraction of the piston. The second one-way check valve 63 allows pressure intensified expansion fluid F2 to flow from the second cylinder towards the outlet 12 of the pressure intensifying means and into the annular barrier space 30, but prohibits the pressure intensified fluid F2 from flowing back from the annular barrier space 30 towards the second cylinder. In this way, the intensified expansion fluid F2 may always enter the annular barrier space 30, but during retraction of the piston, where the second cylinder is filled with low pressure expansion fluid, the pressure intensified expansion fluid will not flow back from the annular barrier space 30.

In order to prevent fluids containing dirty particles from entering the pressure intensifying means through the excess fluid connection 13, typically a filter 70 will be placed in the excess fluid connection, during normal operation of the pressure intensifying means. However, only excess fluid will exit the excess fluid connection into the borehole. However, under special circumstances, such as high pressure fluctuations in the borehole, the filter may become important to the environment inside the pressure intensifying means.

As shown in FIG. 5, there is a void 62 within the piston housing between the first end and the second end of the piston, the void 62 may be connected to the exterior of the pressure intensifying means 10 through a second excess fluid connection 13*c*, and typically a second filter 70*b* will also be placed in the second excess fluid connection 13*c* to avoid impurities near the moving piston 60.

Figure 6:
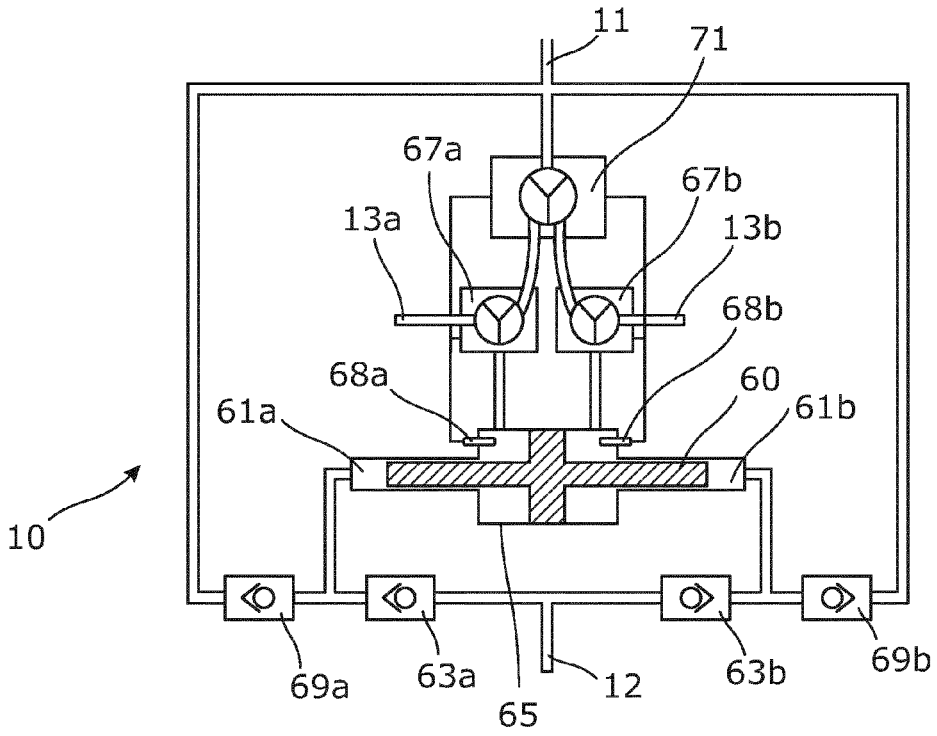
FIG. 6 shows diagram of a hydraulic pressure intensifier with a double-acting piston.

The pressure intensifying means 10 shown in FIG. 6 comprises a double-acting piston. In order to increase the speed/volume-flow of the pressure intensifying means compared to the pressure intensifying means shown in FIG. 5, the principle of a double-acting piston may be utilised in the pressure intensifying means. During retraction of the piston shown in FIG. 5, the pressure intensifying means becomes inactive in terms of pressurisation. By using a double-acting piston, both forward and backward motion when reciprocating the piston may be used to pressurise, thereby avoiding any inactive periods and again increasing speed/volume flow of the pressure intensifying means to allow the annular barrier to be expanded in a shorter period of time. Since additional technical features, as explained, are required in systems with a double-acting piston, these systems are typically less rugged, and the choice between double-acting or single-acting piston is therefore a trade-off between speed and ruggedness.

The pressure intensifying means comprising a double-acting piston may further comprise a first and a second pilot control valve 67*a*, 67*b* for controlling fluid communication between a first and a second end of a first cylinder 65*a*, 65*b*, a fluid direction control valve 71 and a first and a second excess fluid connection 13*a*, 13*b* providing fluid communication from the pressure intensifying means to the borehole 100. As is the case for the pressure intensifying means shown in FIG. 5, the fluid flow to the first cylinder is controlled by a pilot control valve. Only when working with double-acting pistons, both sides of the piston may be pressurised, and therefore two pilot control valves may be required and furthermore an additional fluid direction control valve determines whether the expansion fluid from the inlet 11 is directed towards the first or the second pilot control valve 67*a*, 67*b*. The first pilot control valve 67*a* has two positions, a first position wherein fluid communication is provided between the first end of the first cylinder 65*a* and the fluid direction control valve 71 for applying expansion fluid F1 in the first end of the cylinder 65*a* during pressurisation of a second end of a second cylinder, and further it has a second position wherein fluid communication is provided between the first cylinder and the first excess fluid connection 13*a* and analogously, the second pilot control valve has two positions. Also, the pressure intensifying means comprising a double-acting piston may comprise the fluid direction control valve 71 which then is controlled by a first and a second pilot 68*a*, 68*b*, the first pilot 68*a* determining when the piston 60 reaches a stop position in the first end 65*a* of the first cylinder and the second pilot determining when the piston 60 reaches a stop position in the second end 65*b* of the first cylinder, and wherein the fluid direction is changed from one pilot control valve to another by the fluid direction control valve 71 when the piston reaches a stop position, thereby engaging the first or second pilot 68*a*, 68*b*. Also, the first and second check valves 63*a*, 63*b*, 69*a*, 69*b* are present in both circuits, providing pressure on each side of the double-acting piston 60, with the same functionality as in the pressure intensifying means shown in FIG. 5.

In some embodiments (not shown), the pressure intensifying means may comprise a pressurised gas which may be released into the annular barrier by releasing a gas control valve by the expansion fluid.

Figure 7:
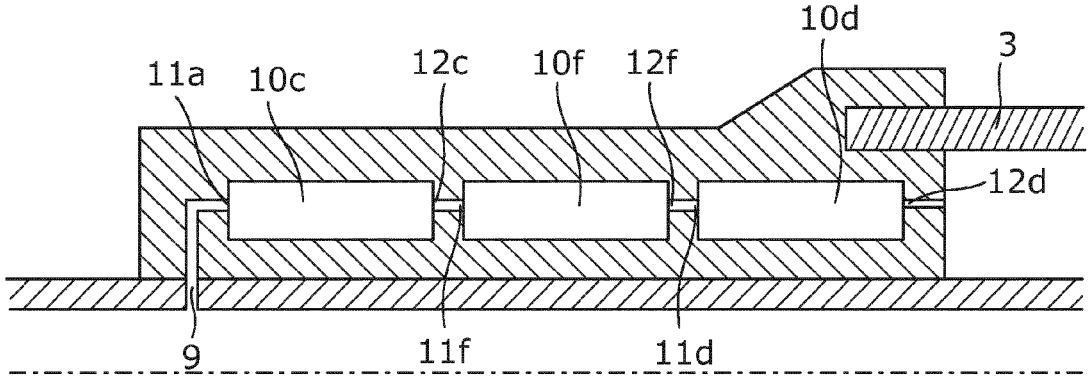
FIG. 7 shows a plurality of pressure intensifying means arranged in series.

FIG. 7 shows the annular barrier comprising a first and second pressure intensifying means 10*c*, 10*d* arranged in series, the first pressure intensifying means 10*c* comprising a first inlet 11*a* and a first outlet 12*c* and the first inlet being 11*a* in fluid communication with the expansion opening 9, and wherein the second pressure intensifying means 10*d* comprises a second inlet 11*d* and a second outlet 12*d* and the second outlet 12*d* being in fluid communication with the annular barrier space 30. As can be seen, the annular barrier further comprises an intermediate pressure intensifying means 10*f* arranged in series, wherein the intermediate pressure intensifying means comprises an intermediate inlet 11*f* in fluid communication with the first outlet 12*c* and the intermediate outlet 12*f* being in fluid connection with second inlet 11*d*.

By placing pressure intensifying means in series, a higher pressure may be obtained in the pressure intensified fluid F2 used to expand the expandable sleeve 3.

Figure 8:
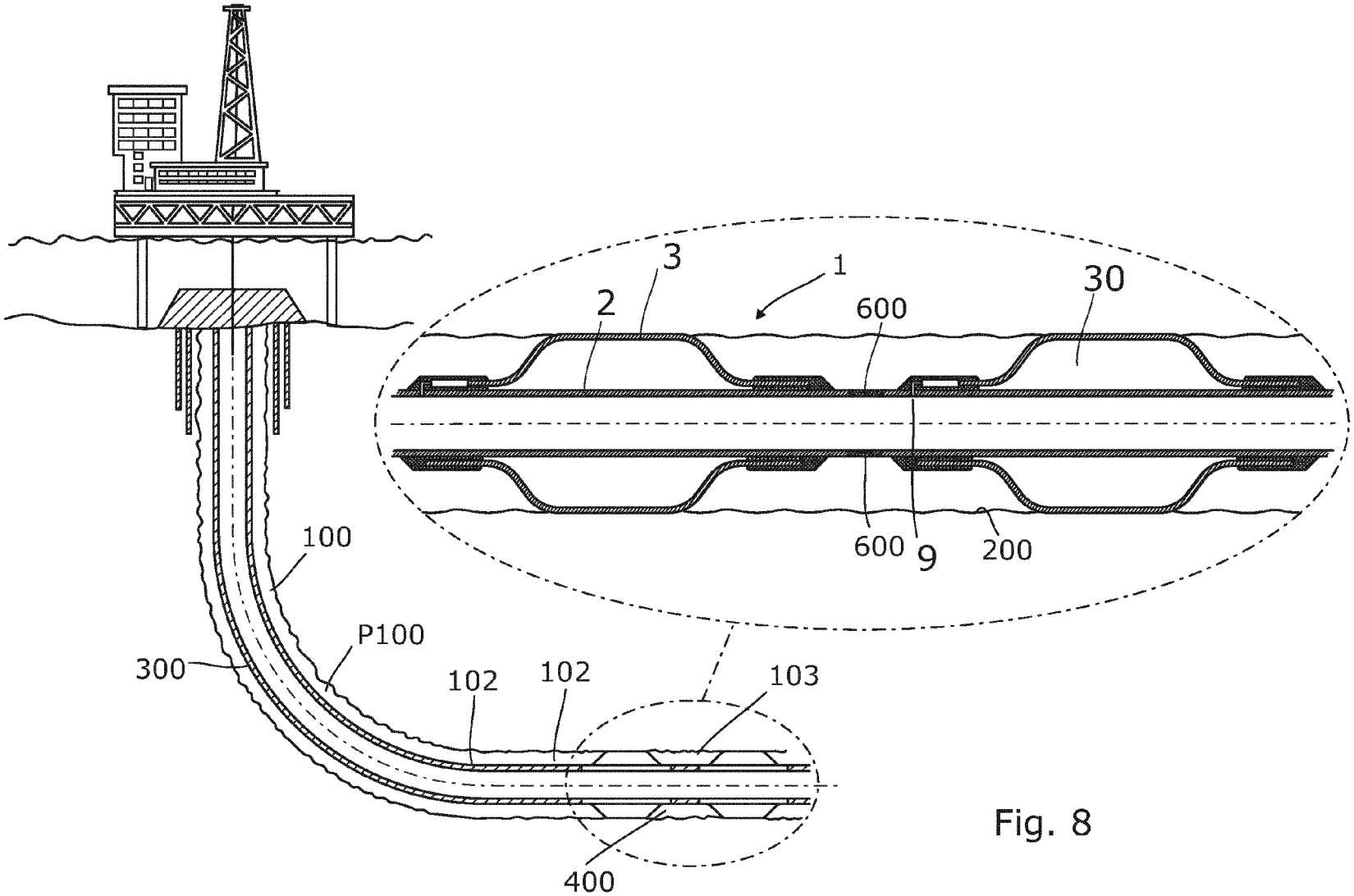
FIG. 8 shows an annular barrier system.

FIG. 8 shows two annular barriers 1 sealing off an inflow control section 600 in a downhole environment.

An annular barrier system according to the invention comprises a well tubular structure and at least one annular barrier arranged as part of the tubular structure. A plurality of annular barriers are mounted as part of the well tubular structure during completion of the well, e.g. to fix the well tubular structure in the borehole and to provide zone isolation. Other annular barriers may be applied to seal off specific volumes in the borehole, e.g. an inflow control zone 600 as that shown in FIG. 8.

A method of placing an annular barrier 1 in an annulus comprises the steps of connecting the annular barrier with a well tubular structure 300 and then placing the unexpanded annular barrier in a desired position downhole. When the barrier is in position, an expansion fluid may be pressurised within the tubular part, thereby forcing the fluid to enter the expansion opening. When the expansion enters the expansion opening 9 and thereafter the pressure intensifying means 10, the pressure in the annular barrier space 30 begins to intensify by means of the pressure intensifying means, thereby expanding the expandable sleeve.

Furthermore, a method of using annular barriers in an annulus to seal off an inflow control section comprises the steps of connecting two annular barriers with other well tubular structure parts and in between them an inflow control section 600 and then placing the two annular barriers and the inflow control section in a desired position downhole. When the two barriers and the inflow control section is in place, the tubular part 2 is pressurised by the expansion fluid, and the annular barriers are expanded by the pressure intensified expansion fluid F2 from within the tubular part by means of the pressure intensifying means, thereby providing a zone isolation between a first zone 102 and a second zone 103 of the borehole. The first zone now has a first fluid pressure and the second zone has a second fluid pressure and the pressure of the tubular part may be stopped and the inflow control section may be activated for starting a production of fluid into the well tubular structure.

The pressurised fluid used to expand the annular barrier may either be pressurised from the top of the borehole 100 and fed through the well tubular structure 300, or be pressurised in a locally sealed off zone in the well tubular structure. The expansion fluid is applied until the expandable sleeve 3 abuts the inside wall 200 of the borehole, which is shown in FIG. 4. When the annular barrier 1 has been expanded using a pressurised fluid and abuts the inside of the borehole wall 200, the annular barrier provides a seal between a first zone 102 and a second zone 103 of the borehole. Thus, the first zone 102 is on one side of the annular barrier 1 and the second zone 103 is on the other side of the annular barrier 1.

When the expandable sleeve 3 of the annular barrier 1 is expanded, the diameter of the sleeve is expanded from its initial unexpanded diameter to a larger diameter. The expandable sleeve 3 has an outside diameter D and is capable of expanding to an at least 10% larger diameter, preferably an at least 15% larger diameter, more preferably an at least 30% larger diameter than that of an unexpanded sleeve.

Furthermore, the expandable sleeve 3 has a wall thickness t which is smaller than a length L of the expandable sleeve, the thickness preferably being less than 25% of the length, more preferably less than 15% of the length, and even more preferably less than 10% of the length.

The expandable sleeve 3 of the annular barrier 1 may be made of metal, polymers, an elastomeric material, silicone, or natural or synthetic rubber.

In order to increase the thickness of the sleeve 3, additional material may be applied (not shown) onto the expandable sleeve, e.g. by adding welded material onto the outer face.

In another embodiment, the thickness of the sleeve 3 is increased by fastening a ring-shaped part onto the sleeve (not shown).

In yet another embodiment, the increased thickness of the sleeve 3 is facilitated using a varying thickness sleeve 3 (not shown). To obtain a sleeve of varying thickness, techniques such as rolling, extrusion or die-casting may be used.

An expansion tool may be used to expand the annular barrier and may comprise an isolation device for isolating a first section outside the passage or valve between an outside wall of the tool and the inside wall of the well tubular structure. The pressurised fluid is obtained by increasing the pressure of the fluid in the isolation device. When a section of the well tubular structure outside the passage of the tubular part is isolated, it is not necessary to pressurise the fluid in the entire well tubular structure, just as no additional plug is needed as is the case in prior art solutions. When the fluid has been injected into the annular barrier space, the passage or valve is closed.

The tool may also use coiled tubing for expanding the expandable sleeve 3 of an annular barrier 1 or of two annular barriers at the same time. A tool with coiled tubing can pressurise the fluid in the well tubular structure without having to isolate a section of the well tubular structure. However, the tool may need to plug the well tubular structure further down the borehole from the two annular barriers or barriers 1 to be operated. The annular barrier system of the present invention may also employ a drill pipe or a wireline tool to expand the sleeve.

In one embodiment, the tool comprises a reservoir containing the pressurised fluid, e.g. when the fluid used for expanding the sleeve 3 is cement, gas or a two-component compound.

The well tubular structure can be the production tubing or casing or a similar kind of tubing downhole in a well or a borehole. The annular barrier 1 can be used both between the inner production tubing and an outer tubing in the borehole or between a tubing and the inner wall of the borehole. A well may have several kinds of tubing, and the annular barrier 1 of the present invention can be mounted for use in all of them.

The valve may be any kind of valve capable of controlling flow, such as a ball valve, butterfly valve, choke valve, check valve or non-return valve, diaphragm valve, expansion valve, gate valve, globe valve, knife valve, needle valve, piston valve, pinch valve or plug valve.

The expandable tubular metal sleeve 3 may be a cold-drawn or hot-drawn tubular structure. The sleeve may be seamless or welded.

The expandable tubular metal sleeve 3 may be extruded, die-cast or rolled, e.g. hot-rolled, cold-rolled, roll-bended etc., and subsequently welded.

The fluid used for expanding the expandable sleeve 3 may be any kind of well fluid present in the borehole surrounding the tool and/or the well tubular structure. Also, the fluid may be cement, gas, water, polymers, or a two-component compound, such as powder or particles mixing or reacting with a binding or hardening agent. Part of the fluid, such as the hardening agent, may be present in the annular barrier space before injecting a subsequent fluid into the annular barrier space.

Although the invention has been described in the above in connection with preferred embodiments of the invention, it will be evident for a person skilled in the art that several modifications are conceivable without departing from the invention as defined by the following claims.

The invention claimed is:

1. An annular barrier to be expanded in an annulus between a well tubular structure and an inside wall of a borehole for providing zone isolation between a first zone and a second zone of the borehole, comprising:

a tubular part for mounting as part of the well tubular structure and having an expansion opening, an expandable sleeve surrounding the tubular part, each end of the expandable sleeve being connected with the tubular part, and an annular barrier space between the tubular part and the expandable sleeve, wherein the annular barrier further comprises a pressure intensifying assembly having an inlet in a first end in fluid communication with the expansion opening and having an outlet in a second end in fluid communication with the annular barrier space, and wherein the pressure intensifying assembly comprises a piston having a first end and a second end, the piston being slidably arranged within a piston housing, the piston housing comprising a first cylinder having a first inner diameter corresponding to an outer diameter of the first end of the piston and having a first end surface area, and a second cylinder having a second diameter corresponding to an outer diameter of the second end of the piston and having a second end surface area, the first end surface area being larger than the second end surface area, wherein the pressure intensifying assembly further comprises a feed fluid connection configured to be in fluid communication with the inlet and the expansion opening for allowing fluid to enter the second cylinder, and wherein the pressure intensifying assembly further comprises a first one-way check valve arranged in the feed fluid connection for preventing fluid from exiting the second cylinder during compression of fluid by the piston and for allowing fluid to enter the second cylinder during decompression of fluid by the piston, wherein the pressure within the annular barrier space is increased by the pressure intensifying assembly to expand the expandable sleeve, whereby pressure in the annular space is greater than a pressure inside the tubular part adjacent the annular barrier, and wherein each end of the expandable sleeve is connected to the tubular part by a respective connecting part, and wherein the pressure intensifying assembly is disposed at least partly within one of the respective connecting parts.

2. An annular barrier according to claim 1, wherein the pressure intensifying assembly further comprises a second one-way check valve arranged between the feed fluid connection and the outlet of the pressure intensifying assembly for preventing pressurised fluid from entering the second cylinder during decompression of fluid by the piston and for allowing pressurised fluid to exit the pressure intensifying assembly through the outlet during compression of fluid by the piston.

3. An annular barrier according to claim 1, wherein the pressure intensifying assembly comprises a plurality of pressure intensifying assemblies.

4. An annular barrier according to claim 3, wherein the outlet of the pressure intensifying assembly comprises a pressure collecting chamber in fluid communication with a plurality of second ends of a plurality of pistons and in fluid communication with the annular barrier space.

5. An annular barrier according to claim 1, wherein an excess fluid connection between the pressure intensifying assembly and the borehole allows fluid to flow from the pressure intensifying assembly into the borehole.

6. An annular barrier according to claim 1, wherein the pressure intensifying assembly comprises a void within the piston housing between the first end and the second end of the piston.

7. An annular barrier according to claim 1, further comprising a one-way valve arranged in fluid communication with the borehole and the annular barrier space, allowing fluid flow from the borehole into the annular barrier space.

8. An annular barrier according to claim 1, wherein the annular barrier comprises a first and a second pressure intensifying assemblies arranged in series, the first pressure intensifying assembly comprising a first inlet and a first outlet and the first inlet being in fluid communication with the expansion opening, the second pressure intensifying assembly comprising a second inlet and a second outlet and the second outlet being in fluid communication with the annular barrier space.

9. An annular barrier according to claim 1, wherein the annular barrier comprises a first and a second pressure intensifying assemblies and at least one intermediate pressure intensifying assembly arranged in series, the first pressure intensifying assembly comprising a first inlet and a first outlet and the first inlet being in fluid communication with the expansion opening, the second pressure intensifying assembly comprising a second inlet and a second outlet and the second outlet being in fluid communication with the annular barrier space, and wherein the at least one intermediate pressure intensifying assembly comprises an intermediate inlet in fluid communication with the first outlet and an intermediate outlet being in fluid connection with second inlet.

10. An annular barrier according to claim 1, wherein the pressure intensifying assembly comprises a hydraulic pressure intensifier or a hydraulic pressure intensifier with a double-acting piston.

11. An annular barrier according to claim 1, wherein a second pressure intensifying assembly is arranged in an end of the annular barrier opposite to the pressure intensifying assembly.

12. Annular barrier system comprising:

a well tubular structure, and at least an annular barrier according to claim 1 arranged as part of the well tubular structure.

13. A method of placing the annular barrier according to claim 1 in the annulus, comprising the steps of:

connecting the annular barrier with the well tubular structure, placing the unexpanded annular barrier in a desired position downhole, pressurising a fluid within the tubular part, intensifying the pressure only in the annular barrier space by the pressure intensifying assembly, and expanding the expandable sleeve.

14. A method of using annular barriers according to claim 1 in an annulus to seal off an inflow control section, comprising the steps of:

connecting two annular barriers with the well tubular structure and in between them the inflow control section, placing the two annular barriers and the inflow control section in a desired position downhole, pressurising the tubular part and expanding the annular barriers by intensifying the pressure only in the annular barriers for providing zone isolation between a first zone and a second zone of the borehole, the first zone having a first fluid pressure and the second zone having a second fluid pressure, stopping the pressurising of the tubular part, and activating the inflow control section for starting a production of fluid into the well tubular structure.

* * * * *